US006968297B1

(12) United States Patent
Ziakovic et al.

(10) Patent No.: US 6,968,297 B1
(45) Date of Patent: Nov. 22, 2005

(54) METHOD AND DEVICE FOR SIMULATING AND REPRESENTING THE DRESSING OF A MANNEQUIN

(75) Inventors: Michel Ziakovic, Villenave d'Ornon (FR); Ramon Yepes Segovia, Madrid (ES)

(73) Assignee: Lectra SA, Cestas (FR)

( * ) Notice: Subject to any disclaimer, the term of this patent is extended or adjusted under 35 U.S.C. 154(b) by 684 days.

(21) Appl. No.: 09/857,685

(22) PCT Filed: Oct. 9, 2000

(86) PCT No.: PCT/FR00/02798

§ 371 (c)(1),
(2), (4) Date: Jun. 7, 2001

(87) PCT Pub. No.: WO01/26496

PCT Pub. Date: Apr. 19, 2001

(30) Foreign Application Priority Data

Oct. 8, 1999 (FR) ..... 99 12563

(51) Int. Cl.[7] ..... G06F 17/50
(52) U.S. Cl. ..... 703/1; 345/419; 345/420
(58) Field of Search ..... 703/1, 6, 7; 345/420, 345/419, 630; 33/12; 700/83

(56) References Cited

U.S. PATENT DOCUMENTS 4,137,634 A * 2/1979 Klamar ..... 33/12
4,888,713 A 12/1989 Falk
5,255,352 A 10/1993 Falk
5,495,568 A * 2/1996 Beavin ..... 700/83
5,504,845 A 4/1996 Vecchione
5,615,318 A * 3/1997 Matsuura ..... 345/420
5,825,652 A 10/1998 LeBlond et al.
6,232,980 B1 * 5/2001 Liepa ..... 345/419
6,310,627 B1 * 10/2001 Sakaguchi ..... 345/630

FOREIGN PATENT DOCUMENTS

EP 0 933 728 A2 8/1999

OTHER PUBLICATIONS

McCartney, J. et al., "Modelling Garments in 3D CAD," Proceedings of the 15th International Conference on Computer-Aided production Engineering, CAPE '99, University of Durham, Apr. 19-21, 1999, pp. 125-130, University of Durham School of Engineering, United Kingdom.

* cited by examiner

*Primary Examiner*—Kevin J. Teska
*Assistant Examiner*—Kandasamy Thangavelu
(74) *Attorney, Agent, or Firm*—Smith, Gambrell & Russell, LLP

(57) ABSTRACT

The invention relates to a method of viewing a garment made up of garment pieces and having seam lines on a dummy model. The method comprises:

a step of placing the garment pieces (38, 40) on the surface of the dummy (32) or on a surface derived from the surface of the dummy;

joining together the garment pieces along their seam lines; and relaxing each garment piece from its position on the surface of the dummy to its equilibrium position on the dummy.

The invention also relates to apparatus for implementing the method.

30 Claims, 13 Drawing Sheets

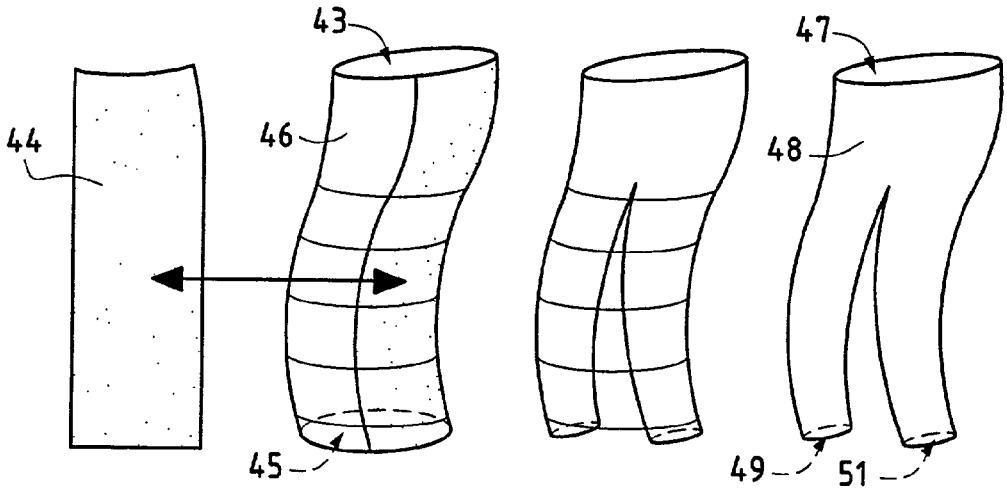
FIG.6
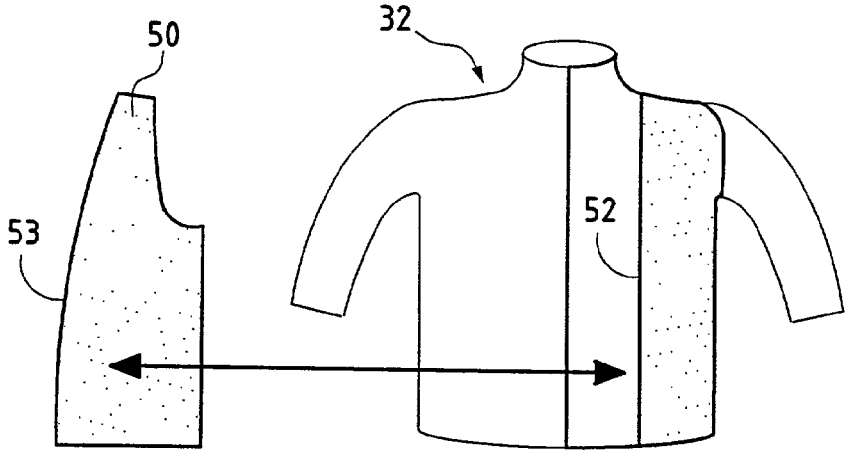
FIG.7
FIG.8
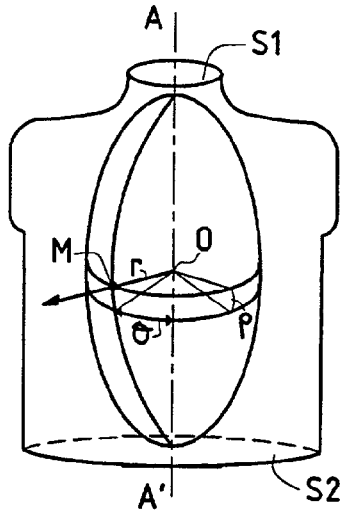

METHOD AND DEVICE FOR SIMULATING AND REPRESENTING THE DRESSING OF A MANNEQUIN

CROSS-RELATED APPLICATION

This application is a 35 U.S.C. §371 application of International PCT Application No. PCT/FR00/02798; filed Jun. 7, 2001.

TECHNICAL FIELD AND PRIOR ART

The invention relates to the field of simulating the dressing of a tailor's dummy or of a mannequin, and is particularly applicable to the clothing and/or fashion industries.

Increasingly, the clothing industry uses databases in which the garments are filed or indexed in two dimensions. The aim is to use the data contained in such databases to simulate the dressing of a dummy, without having to perform the dressing on a "real" conventional dummy.

More precisely, the invention describes a method and apparatus for putting in place on a virtual dummy a loose garment that is initially described by its two-dimensional pieces of fabric. The problem is to sew the pieces together in three-dimensional (3D) space and to place the resulting garment in the correct position around the virtual dummy.

In a known method shown in FIG. 1, garment pieces 2, 4, 6 to be assembled together are placed approximately facing their final positions around a dummy 8. Then, the seam lines are connected together by pieces of "elastic" 10, 12, 14, 16, 18, 20, 22. The fabric is then simulated under conditions of "weightlessness". The pieces converge on one another and finally become stable edge-to-edge. It then remains merely to sew them together.

The simulation of the converging of the pieces in that method takes a long time because, in order to compute the physical behavior of a woven fabric of average stiffness, such as cotton, it is necessary to use differential equation integration algorithms of the Euler type or of the Runge-Kutta type, with a time step size that is considerably shorter than the shortest sustained half-period of oscillation of the differential equation (exceeding such a step size causes errors to increase exponentially, and the fabric thus explodes).

For a reasonable mesh size of the pieces (one-centimeter triangles), a mass per unit area M of about 0.2 kilograms per square meter ($kg/m^2$), and a warp/weft stiffness k of about 1000 newtons per meter (N/m), it is necessary to use a time step size of 0.1 milliseconds (ms). The frequency obtained is thus about 1 kHz ($f=\sqrt{(k/M/2\pi)}$).

Other methods of solving differential equations (referred to as "implicit methods") make it possible to exceed that time step size, but the cost of implementing them is greater than the saving obtained, because of the non-linearity of the equations and of the computations relating to the collisions.

A conventional garment (a shirt) represents about 1.5 square meters ($m^2$) of fabric. With a mean mesh-size of 1 square centimeter ($cm^2$), the mesh for the garment comprises about 15,000 elements. Each computation step requires the forces being applied to each element to be measured, and thus at least four measurements of distance between it and the adjacent elements (warp, weft, and shear), which, in 3D, represents 12 subtractions, 12 multiplications, and above all 4 square root extractions. It is thus necessary to perform about 60,000 square root extractions, and 180,000 multiplications, at least, for each time step.

Curiously, and unfortunately, including viscosities of the order of the critical viscosities makes it necessary to reduce the time step size still further. Therefore, there is little hope of the convergence kinetic energy dissipating very quickly. A very high convergence speed (due to pieces of elastic that are very stiff) gives rise to creasing and stretching, and that can also make it necessary to reduce the time step size. It is thus probably impossible to hope to join the pieces together in under 1 second of simulated time, i.e. 10,000 computation steps. This amounts to a total of 1.8 billion multiplications and 600 million square root extractions. It is also necessary to include the time required for handling the fabric/fabric and fabric/dummy collisions.

Various optimizations are possible, but the total computation time remains considerable (tens of minutes on a "Pentium 2" microprocessor).

Document U.S. Pat. No. 5,615,318 describes a method in which a three-dimensional shape is initially formed by assembling together the garment pieces. Then sections of a standard model of dummy are expanded until some of the expanded sections correspond to sections of the 3D shape, while leaving spaces between the dummy and the garment at the other sections.

Computing the expansion is quite complex. It involves identifying corresponding characteristic points on the dummy and on the pieces of each garment, and computing the lengths of characteristic arcs passing through some of said characteristic points. For example, the characteristic arcs go through the neck, the shoulders, or the bust. An expansion factor is derived for each of the arcs.

The complexity of the computations and the lengths of the computation times are also detrimental to forming the pieces by cutting them out from a woven fabric or from some other material.

SUMMARY OF THE INVENTION

The invention provides a method of viewing a garment made up of garment pieces on a virtual dummy or on a representation of a dummy or of a dummy model, or of dressing a virtual dummy or a dummy model represented in three dimensions with garment pieces, the method comprising:

placing the garment pieces on the surface of the dummy;

joining together the garment pieces along their seam lines; and relaxing the garment pieces from their position on the surface of the dummy to their equilibrium position on the dummy.

The garment piece and the dummy model may be represented by data stored in a memory of a computer.

In the invention, the pieces are firstly "painted" on the surface of the dummy so that they are touching, without taking account of the geometrical shape or of the physical behavior of the fabric. In other words, the pieces are pressed against the dummy. For this step, the pieces are deformed continuously, without tearing or intersection.

They are then "sewn", by geometrical proximity.

Finally, the compression energy of the fabric is minimized, the fabric is relaxed, or "reflated". It goes from a state in which the compression energy is large to a state in which it is reduced to a value compatible with the position of the garment on the dummy.

The resulting 3D shape is then ready for simulating the drape of the fabric.

The method of the invention offers computation time that is short compared with methods that use simulation of the fabric for assembling, sewing, and putting on the clothing, and that take full account at all times of the dimensions and of the forces in the fabric.

The invention avoids the prior steps of simulating the fabric, and then of causing the fabric to converge on the body or the dummy. In particular, it avoids computing the physical behavior of the fabric prior to assembly. It makes it possible to solve the problems of computation time by removing the physical constraints related to simulating the fabric and causing it to converge, and by making or by simulating the seams (joins between the pieces of the garment) directly.

More precisely, the method of the invention enables geometrical constraints (lengths, angles of the fabric) to be ignored temporarily so as to retain only the continuity relationships that are conventional in topology: it implements continuous deformations only.

Finally, the invention makes it possible to avoid complex expansion computations which involve deforming the dummy: in particular, the relaxation involves deforming the garment but not the dummy.

In a particular feature of the invention, the garment pieces are placed on the surface of the dummy by establishing a point-to-point or bijective and continuous relationship between the piece, or at least a portion of the piece, or points representative of such a piece, and a corresponding portion of the surface of the dummy, or points on such a portion.

This relationship makes it possible to apply or to press the garment piece against the dummy.

The relaxation step may comprise:

subdividing the garment piece into a first set of portions; and deforming said set of portions while minimizing an energy function, which may be traction energy.

It may further comprise:

subdividing the garment piece into a second set of portions that are smaller than the portions of the first set; and deforming the second set of portions while minimizing an energy function, which may likewise be the traction energy.

The deformations may be chosen so as to comply with the topological relationships of (euclidean) 3D space. As a result of this choice, it becomes unnecessary to compute collisions in the fabric.

Such a deformation may, for example, comprise:

a displacement along field lines coming from the dummy; and a displacement along the surface of the fabric, in the other directions.

The invention also provides a method of making garment pieces, said method comprising:

pre-viewing the garment on a dummy using a method as described above; and making the pieces of the garment.

The viewing can be performed in a place distinct from the place in which the garment pieces are physically made, the data on the viewed garment pieces being transferred, after viewing or simulation, to the place in which the garment pieces are made.

The invention also provides apparatus for implementing the method of the invention.

Thus, the invention also provides apparatus for viewing garment pieces on a dummy, said apparatus comprising:

computer means or specially-programmed means for:

placing the garment piece on the surface of the dummy or on a surface derived from the surface of the dummy;

joining together the garment pieces along their seam lines; and relaxing the pieces of the garment from their position on the surface of the dummy to their equilibrium position on the dummy; and viewing means for viewing the dummy with the garment pieces on the dummy.

In addition, it is possible to pre-view the selected dummy and/or the selected garment pieces.

The apparatus may further comprise means for modifying a selected garment piece or for replacing a garment piece with another garment piece.

The invention also provides apparatus for making garment pieces, the apparatus comprising:

viewing apparatus of the invention, as defined above;

cutting-out means for cutting out garment pieces; and data-transmission means for transmitting data between the viewing apparatus and the cutting-out means for cutting out the garment pieces.

The cutting-out means for cutting out the garment pieces may be controlled by a micro-computer, the data-transmission means then interconnecting the viewing apparatus and the micro-computer.

The data-transmission means may, for example, be part of a communications network.

BRIEF DESCRIPTION OF THE DRAWINGS

The characteristics and advantages of the invention appear more clearly from the following description of implementations given by way of explanatory and non-limiting example and with reference to the accompanying drawings, in which:

FIGS. 2 to 6 are examples of steps of applying garment pieces to a dummy, in a method of the invention;

FIG. 7 shows a step of inserting a corresponding line on a dummy;

FIG. 8 diagrammatically shows a portion of a dummy and a frame of reference using elliptical coordinates;

DETAILED DESCRIPTION OF IMPLEMENTATIONS

Figure 1:
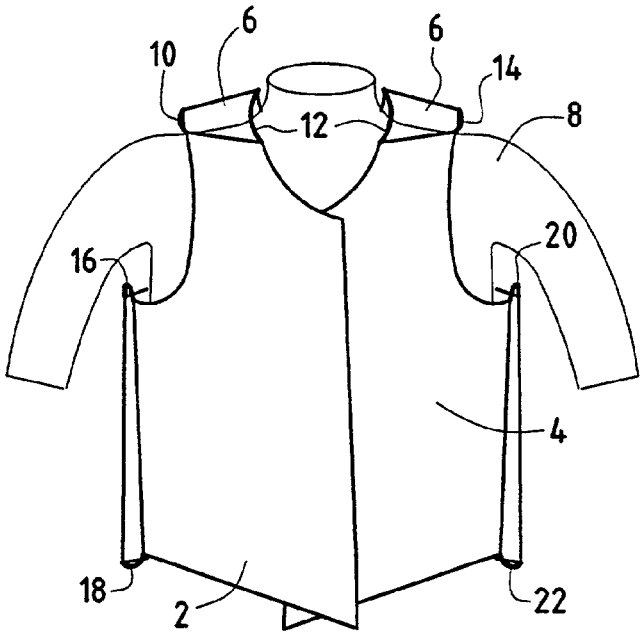
FIG. 1 shows a prior art method of simulating assembly.

The term "dummy" is used below to designate a computer-generated representation of the volume (or of the working portion of the volume) of a tailor's dummy or a human body. For reasons of explanation, the volume is assumed to be described by its outside surface, itself described as a triangular mesh, the vertices of the triangles of the mesh being points of said outside surface. Other representations are possible (parametric outside surface, or else volume defined by voxels (small elements of volume)).

The dummy can thus be represented by data stored in a memory of a computer or of a computer system, the data corresponding, for example to a triangular mesh, or to a parametric outside surface, or else to such voxels.

Various types of dummy may be defined, as a function of various parameters, e.g. age and/or sex of the person represented by the dummy. It is possible to provide various types of dummy and then to select a particular type of dummy. In particular, a "dummies" database may be defined initially, from which a user may can select a particular dummy as a function of needs. Such a database may be pre-stored in a computer system, as described below.

U.S. Pat. No. 5,850,222 describes modelling a dummy. That modelling can be used in the context of the present invention.

The term "garment" is used below to designate a computer-generated representation of the two-dimensional (2D) pieces of a garment, the pieces being represented by their finished outlines and by their cutting outlines. The finished outline of a piece is made up of all of the lines that define the portion of the piece that is apparent once the pieces have been assembled together. The finished outline contains the seam lines, the visible limits of the hems, and the pleat or dart lines. The finished outline is associated with an implicit notion of a "main" portion. The peripheral portion of the fabric (i.e. between the finished outline and the cutting outline) may also be referred to as the "seam width". The pieces are assumed to be described with an x-axis corresponding to the warp direction of the fabric ("with the grain") where the pieces are to be cut out.

The garment can thus be represented by data stored in a memory of a computer or computer system, the data corresponding, for example, to the finished outlines and to the cutting outlines.

Various types of garment may be defined, as a function of various parameters, e.g. the age and/or sex of the person for whom the garment is designed. It is possible to provide various types of garment, and then to select a particular type of garment. In particular, a "garments" database may be defined initially, from which a user can select a particular garment as a function of needs. Such a database may also be pre-stored in a computer system, as described below.

A preliminary step of a method of the invention may thus consist in selecting and/or viewing a particular type of dummy or a particular type of garment.

In general, in the invention, a first step is performed in which the pieces of the garment are placed on the surface or against the surface of the dummy. But in this step, the geometrical shape and the physical behavior of the fabric are not taken into account. Only continuity relationships (which are conventional in topology) are taken into account: for example, the deformations are performed continuously, without tearing or intersecting.

Figure 2:
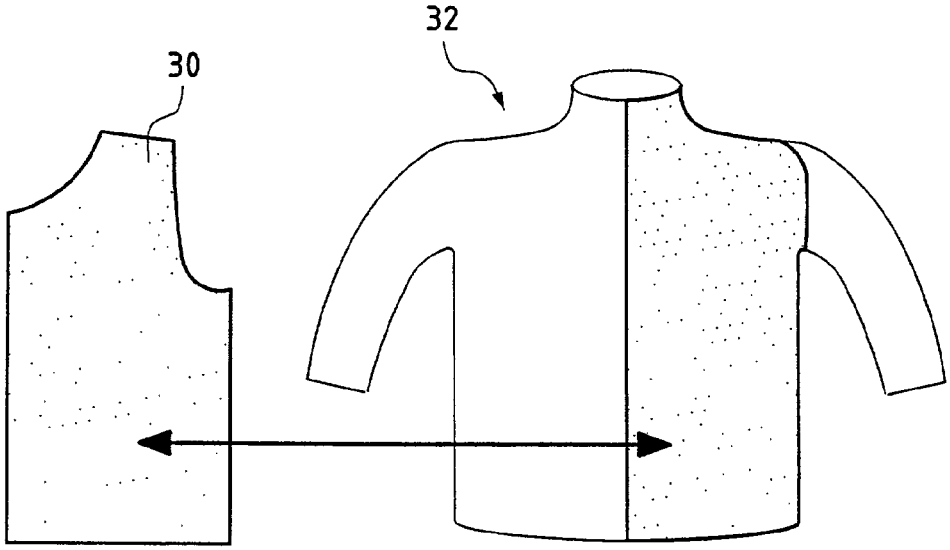

In one example, shown in FIG. 2, a "half-front" piece 30 is applied to the corresponding surface of the bust 32 of a dummy.

Figure 3:
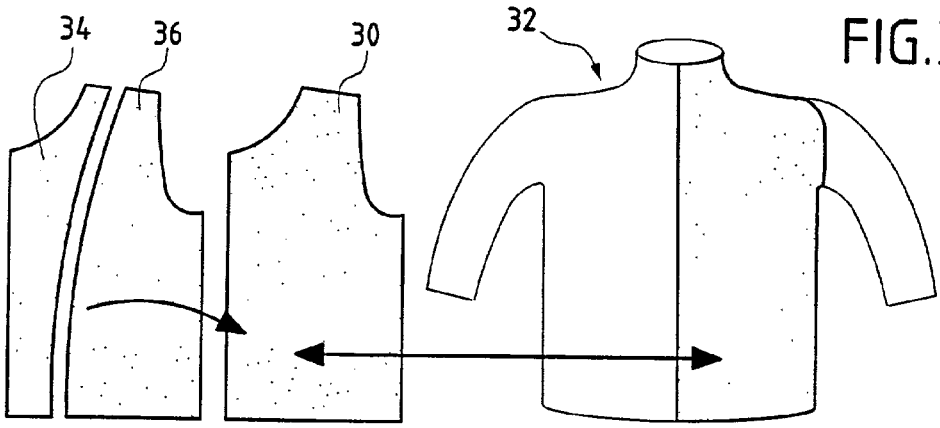

When partial pieces are used, it is possible, as shown in FIG. 3, to pre-merge the parts of the pieces 34, 36 (or the corresponding stored data or sets of data representing the parts of the pieces) to obtain a piece 30 (or the data representing such a piece) to be applied to the portion 32 of the dummy. Each of the parts 34, 36 may initially be part of the database used by the clothes-maker.

Figure 4:
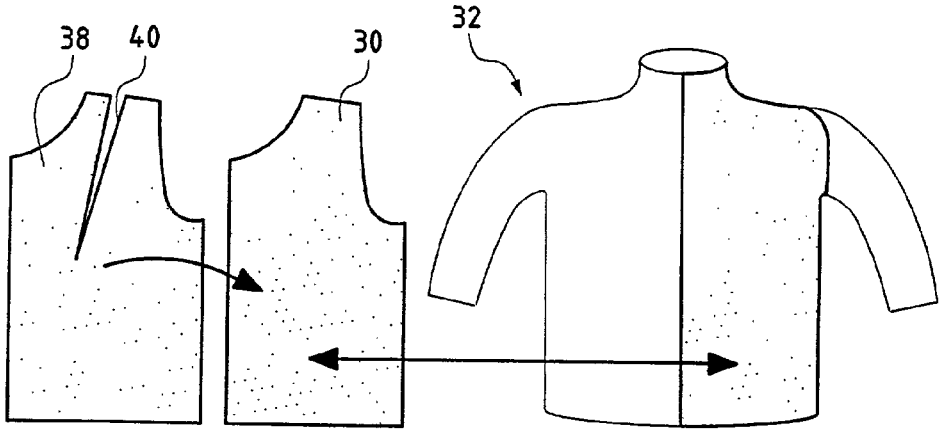

It is also possible, as shown in FIG. 4, when a garment piece 38 is provided with one or more dart cuts 40, to close the dart cuts prior to applying or placing the piece on the dummy. It is not necessary to comply with the lengths of the piece in order to close the dart cuts. The closing is performed on the data that represents the garment piece.

For certain atypical or complex pieces, it is preferable to select the piece (or the data that represents the piece) in sub-pieces of more conventional shape so as to simplify the step of placing or of applying the pieces on the surface of the dummy.

Figure 5:
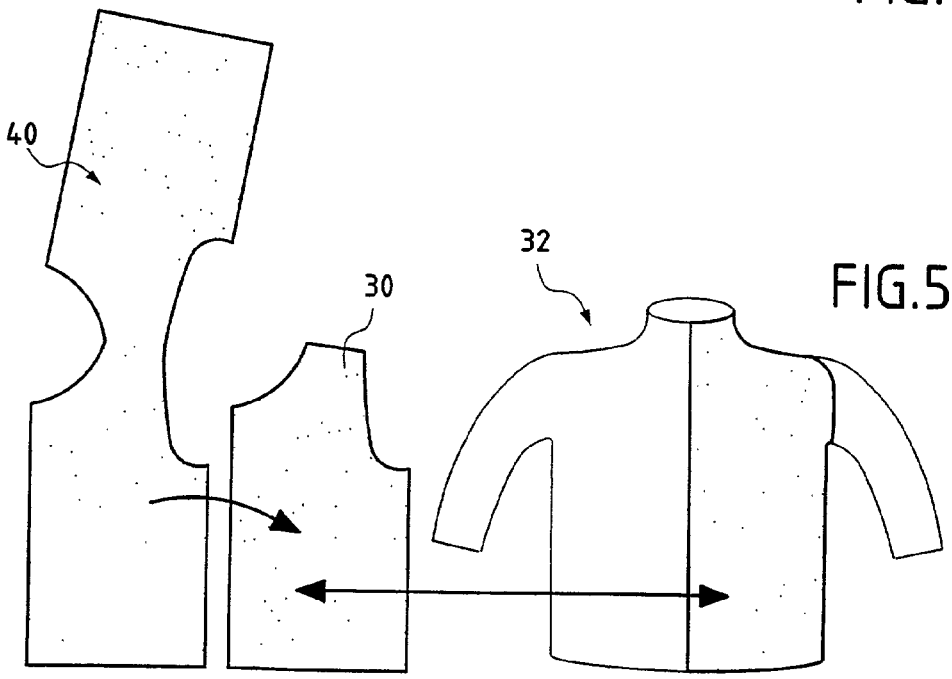

Thus, FIG. 5 shows a piece 40 of initially complex shape comprising the front and back portions of the same half-piece. Subdividing it makes it possible to isolate the front portion 30 which is then applied to the dummy 32. Corresponding subdivision of the data representative of the piece 40 is performed.

In some cases, depending on the type of garment or of piece, instead of the garment or the piece being applied directly to the initial surface of the dummy, it is applied to a surface derived from the dummy or derived from the outside surface that defines the dummy.

This result can be obtained by computing the convex envelope of the working surface of the dummy or of the portion in question of the dummy.

When the working surface comprises two separate portions of the dummy, it is also possible to compute the surface resulting from the accumulation of convex polygons of chosen sections, e.g. horizontal, of the two portions in question of the dummy.

For example, as shown in FIG. 6, for a skirt 44 (or for a dress, etc.), the garment does not correspond topologically to the surface of the dummy 48: once the skirt is applied in three dimensions, the surface of the skirt has two holes 43 and 45, while the working surface of the dummy (reduced to the legs and to the pelvis) has three holes 47, 49, 51. The surface of the dummy is thus corrected by filling in the space between the two legs. The simplest method is to use a dummy that already has this property. It is also possible to obtain this result automatically by computing the convex envelope of the working surface of the dummy, or, even more simply (in terms of computation time), by computing the surface resulting from the accumulation of the convex polygons of horizontal sections of the legs.

Thus, FIG. 6 shows a skirt panel 44 being applied to a surface 46 derived from the dummy 48. The result is equivalent to inserting both legs into a sheath.

Which one of the various techniques described above with reference to FIGS. 2 to 6 is selected depends on knowledge of the type of garment, of the type of piece, and of points and/or lines that are characteristic of the pieces.

All of the transformations and computations are performed on the data representative of the dummies and/or of the garment.

To perform the step of applying the piece to the dummy (or against the dummy), it is possible to define a point-to-point relationship between said piece and the surface of the dummy, or between the data sets representative respectively of the piece and of the surface of the dummy. This relationship complies with the continuity relationships that are conventional in topology.

Thus, each point of the surface of the dummy or (in the example described below with reference to FIG. 6) of the surface derived from the dummy is associated with only one point of the garment or of the garment piece to be applied.

More generally, it is possible to define bijective and continuous relationships (correspondences or homologies) between the 2D pieces of the garment (or the corresponding representative data) and portions of the surface of the dummy or portions of surface merely derived from the dummy (or the corresponding representative data).

The examples given above, with reference to FIGS. 2 and 6 can thus be described in terms of a one-to-one continuous relationship, or point-to-point relationship, or in terms of continuous bijection, i.e. correspondence or "homology".

FIG. 2 then shows a correspondence or homology between a half-front piece and the corresponding surface of the dummy, and FIG. 6 shows a correspondence or homology between a skirt panel and a surface derived from the dummy. In the example shown in FIG. 5, the fact that the complex piece is subdivided prior to computation makes it possible to simplify computing the correspondence or the homology.

More generally, it is possible to define topological relationships between the garment and the dummy (or the body) that the garment dresses, or between the data representative of the garment and of the dummy or of the body, which relationships are expressed by surfaces and/or curves and/or corresponding (or homologous) points.

Thus, in another example, shown in FIG. 7, for a partial piece 50, it is possible to construct on the dummy 32 one or more border lines 52 that correspond or is homologous to the non-conventional line(s) 53 of the piece 50.

A method of establishing such a correspondence relationship or an homology is described below.

In addition, the garment or the piece 2D or the corresponding representative data is given a mesh that is suitable for simulating the fabric, e.g a triangular mesh.

By means of the correspondence or the homology and of the normals to the surface of the dummy, the mesh of the pieces is then transferred layer-by-layer (lining, outer layer, pockets) to the 3D surface of the dummy. The pieces are then pressed against the surface of the dummy in unrealistic manner. It is possible to add a small amount of thickness between successive layers, in order to put the pieces in the order in which they lie at the end of the method.

The meshes of the pieces are then joined together by means of the 3D lines and using the fact that the meshes are geometrically contiguous.

The garment is then topologically complete, sewn together and put on the dummy. However, it is generally extremely compressed and deformed (for example, it may be stretched in places) in a manner that is impossible to achieve physically. This is normal because the garment is pressed against the dummy. As explained above, the initial steps of the method of the invention do not attempt to comply with the mechanical and/or geometrical aspects of the material of which the garment is made.

In addition, for any given shape of garment piece, the result of the "pressing" is the same regardless of the size of said garment piece.

A method is described below which makes it possible to build up correspondence between the dummy and a garment piece.

The dummy is firstly separated into various simple portions:

torso and pelvis;

legs (or tops and bottoms of legs); and arms (or forearms and upper arms).

If a piece covers a plurality of said portions, the piece is further subdivided along a corresponding or homologous line, as described above with reference to FIG. 5.

As shown in FIG. 8, the portions of the dummy are described in terms of elliptical co-ordinates. For each portion, the most suitable axis AA' is chosen: in the example shown in FIG. 8 (torso of the dummy), an axis is chosen that passes firstly through the center of symmetry of a first section $S_1$ (passing through the neck) and secondly through the center symmetry of a second section $S_2$ (an abdominal section in this example). Each point M is thus described by a set of co-ordinates r, ρ, θ, where r is the distance from the point M to the center O of the co-ordinate reference frame. ρ and θ make it possible to identify the point M respectively relative to a horizontal plane and to a vertical plane of reference.

It is possible that, for certain surfaces, a (ρ, θ) pair exists that corresponds to a plurality of values of r. That means that, in a certain direction, there are a plurality of "levels" of the surface of the dummy, at different distances from the center O. In which case, it is possible to modify the volume of the dummy by keeping only that point or those points for which r is at its maximum. Another example of modification of the surface of the dummy is described above (FIG. 6). It is the modified surface or, in the example described, the surface defined by the points of maximum r co-ordinate that define the surface from which the correspondence or the homology is established.

A portion that corresponds topologically to the piece is then isolated from the volume by using the characteristic lines of the dummy. Said characteristic lines define surfaces of the dummy that can be laid out flat.

Figure 9A:
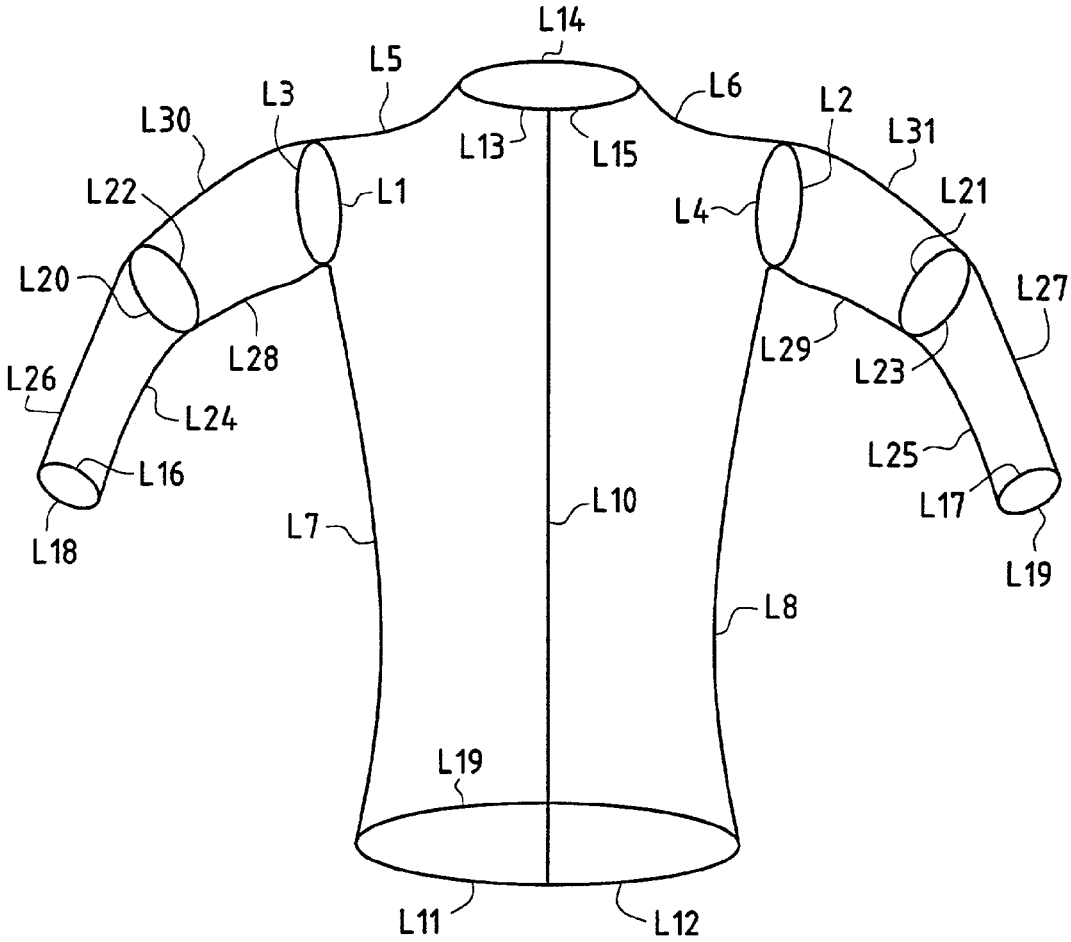
FIGS. 9A and 9B are diagrammatic views respectively showing characteristic lines of a portion of a dummy, and a portion of a dummy that corresponds topologically to a garment piece.

Examples of such lines Li (i=1, 2, . . . 31) are given for the upper portion of a dummy in FIG. 9A:

L1, L3: lines defining the right arm socket;

L2, L4: lines defining the left arm socket;

L5: line defining the right shoulder;

L6: line defining the left shoulder;

L7: line defining the right side;

L8: line defining the left side;

L9, L11, L12: lines defining the waist;

L10: line defining the middle of the front;

L13, L14, L15: lines defining the neck;

L16, L18: lines defining the right wrist;

L17, L19: lines defining the left wrist;

L20, L22: lines defining the right elbow;

L21, L23: lines defining the left elbow;

L24, L26: lines defining the right forearm;

L25, L27: lines defining the left forearm;

L28, L30: lines defining the right upper arm; and

L29, L31: lines defining the left upper arm.

Figure 9B:
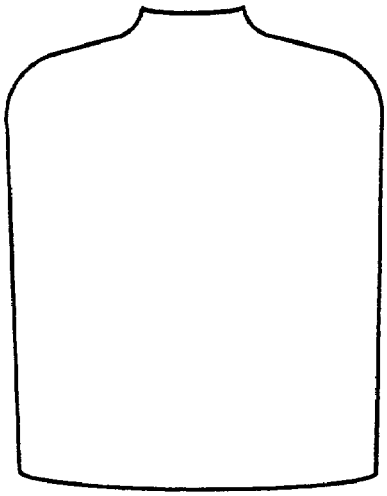

FIG. 9B shows the upper front portion of a dummy, outlined along certain characteristic lines.

Figure 10:
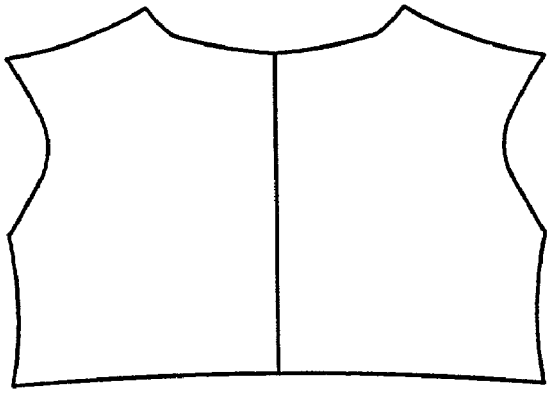
FIG. 10 shows the portion of dummy of FIG. 9B as developed in a plane.

This corresponding or homologous portion (or the data representing said portion) is then projected (FIG. 10) on the ($\rho$, $\theta$) plane. This operation and the resulting outline is referred to as the "projection" of the piece on the dummy. The data relating to the projection is stored.

This projection is in bijection with the surface of the dummy (corrected by the maximum radius).

A projection of the selected zone of the dummy is thus made previously on a plane. Thus, a first bijection is established between the surface (in 3D) of the dummy (or the data representative of said surface) and its projection on a plane.

Figure 11:
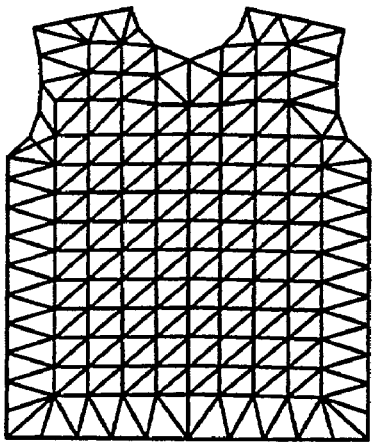
FIG. 11 shows a triangulation of a garment piece.

In addition, as shown in FIG. 11, on the basis of the shape of the piece, a triangulation is built, by maintaining the same number of points on the portions of the outline that are sewn together with other pieces.

The triangulation (the mesh) of the piece is then deformed progressively so as to bring it to coincide with its projection, while avoiding any turning over of the triangles. A description is given below of displacing a point of triangular mesh, without any turning over.

The deformation algorithm used consists, in each step, firstly in displacing the points of the outline towards a new position closer to the desired outline, while complying with the constraint of not turning over the triangles, and while ensuring that the new outline remains a simple polygon, i.e. that it is not self-intersecting. The triangles can be superposed in two ways: by a triangle turning over, i.e. upside-down, or by the polygon being a complex polygon. Then, all of the other points of the triangulation are displaced to the location of the mean of the points that surround them, while complying with the constraint of the triangles not being turned over. For each point, the center of gravity of its adjacent points is computed, and said point thus follows the center of gravity. The deformation of the triangular mesh is thus based on mean displacement effects.

In practice, the initial and final outlines are sufficiently similar for it often to be unnecessary to comply with the constraint of the polygon being a "simple polygon". It suffices for the initial triangulation to be reduced, by a scale factor, for it to fit within its projection. It is then possible to go in a straight line, step-by-step, from the outline of the mesh to the corresponding point of the projection.

A reversible projection is thus obtained of each point on the piece onto a point on the dummy. The data concerning this projection is stored. In practice, the correspondences of the vertices of the triangles with the points of the projection of the dummy are stored. In addition, the seam lines are obtained (the corresponding data of which is also stored).

A mapping of this projection makes it possible to put the pieces into place on the surface of the dummy.

In the invention, two bijections are performed in succession:

- a first bijection, between the dummy or a portion of it as defined in three dimensions, and a projection of said dummy or of said portion in two dimensions; and
- a second bijection, between the projection of the dummy and the corresponding piece(s) of garment, which has or each of which has a two-dimensional representation.

By means of the stored data concerning these operations, a combination of the two bijections makes it possible to press the garment (or its innermost layer) against the surface of the dummy, or else to place the garment pieces on the surface of the dummy, since each point of the garment piece in question is in correspondence with a point of the surface of the dummy.

The layers making up the garment (lining, cloth, neck, etc.) are placed in 3D in successive layers, separated by a thickness that is small enough to preserve the bijectivity. This thickness is related to the minimum radius of curvature of the surface of the dummy.

More precisely, for each portion of the dummy, the thickness between two successive layers is chosen to be very small compared with the radius of curvature of said portion of the dummy, and the sum of the successive thicknesses is smaller than the same radius of curvature. The innermost layer is preferably pressed against the dummy. In other words, the thickness between said innermost layer and the surface of the dummy is zero.

The seams or the joins between the garment pieces are then formed along their seam lines, i.e. the points and the sides belonging to the sewn edges are merged (the bijectivity makes it possible to find them). This operation is performed on the data representative of the pieces at the end of the step of putting them in place on the surface of the dummy.

Figure 12:
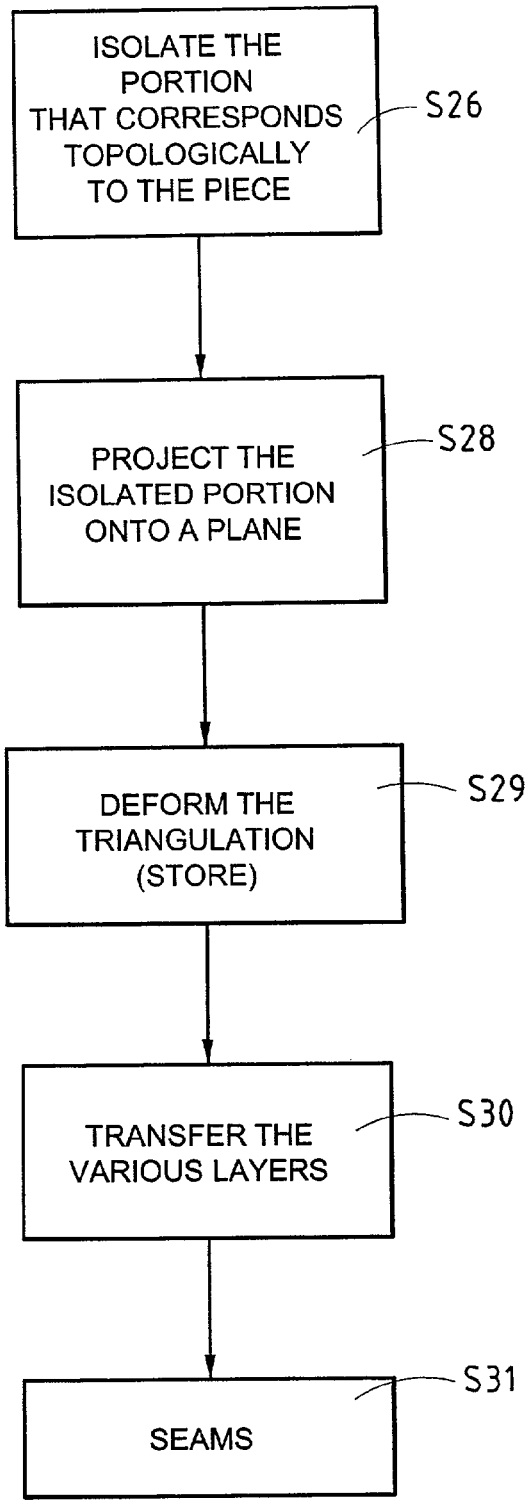
FIG. 12 shows the steps of a method of pressing a garment piece against the dummy.

FIG. 12 summarizes the operations of pressing a garment against the dummy, which operations are in fact performed on the data representative of the garment pieces and of the dummy.

In a first step (S26), a portion that corresponds topologically or is topologically homologous to the piece is isolated from the volume of the dummy.

Then (step S28), said portion is projected in two dimensions onto a plane.

The triangulation of the garment piece, as obtained previously or simultaneously to the preceding operations, is then deformed (step S29).

The data obtained during the two preceding operations can be stored.

The various layers of garment are then transferred (step S30) against the surface of the dummy.

Finally, the seams are formed (the garment pieces (or their representative data) are joined together along their seam lines: step S31).

The garment is then ready to be relaxed.

The object of the relaxation is to bring each garment piece towards its equilibrium state. More precisely, the energy state of the fabric is initially very high because of the topological processing explained above, and it is brought down towards a value close to the minimum, compatible with launching simulation of the material. Various algorithms are possible, it is possible to use a model that may be of various levels of simplicity and/or realism for simulating the fabric (handling the collisions), by direct insertion in such a model.

Comparing the various characteristics of fabrics shows that (in general) the dominant energy factor (for any displacement) is traction strength. Traction strength is generally at least 100 times greater than shear strength, and even greater relative to bending strength, for typical curvatures. Bending strength becomes non-negligible if an attempt is made to fold the fabric through a sharp angle.

Figure 13:
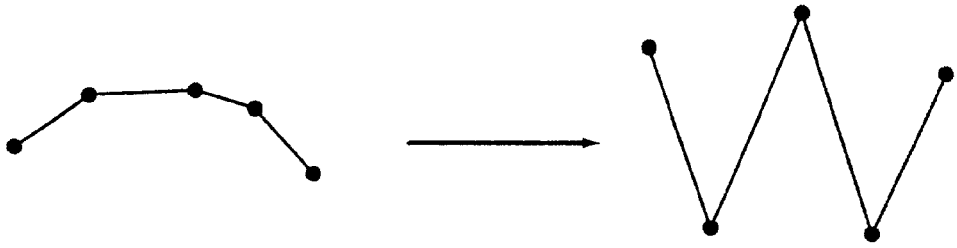
FIG. 13 diagrammatically shows a displacement-saving method for re-establishing the lengths of a compressed chain of straight lines.

The method that is most economical in terms of displacement for re-establishing the lengths of a compressed chain of straight lines (compression is the general case) consists, as shown in FIG. 13, in "creasing" the line.

This what is conventionally performed, e.g. in the context of algorithms that displace each point to re-establish the distances to its adjacent points. But problems then arise that are related to obtaining curvatures that are too high. In addition, the folds obtained are then a direct function of the mesh size and they are thus not physical parameters. Finally, fast anti-collision algorithms have computation times that are generally closely related to the evenness of the surfaces to be processed.

Inserting bending strength into the algorithm to combat creasing results in more cumbersome computations. In addition, the bending strength must then be exaggerated (compared with the bending strength of the fabric), and this can lead to a blocked solution (local minimum) in which high traction strengths remain that are compensated by high bending strengths.

In the invention, it is also possible to address the problem starting from large surfaces, and then "moving down" towards smaller surfaces. For example, firstly the entire garment is "deformed" uniformly, preferably by seeking a traction energy minimum (examples of energy computation are given below). Then a set of large sub-pieces of the garment are deformed, followed by sets of smaller and smaller portions, etc. The size of a portion may be defined as a function of the number of triangles that it contains: thus the mean number of triangles of each portion of the first set is chosen to be larger than the mean number of triangles of each portion of the following set, and the second number is itself larger than the mean number of triangles in each portion of a third set, etc. Creasing is avoided by using "gentle" deformations of space, i.e. preferably continuous, differentiatable, and preferably having derivatives that are continuous ($C^2$ function, from a mathematical point of view).

This technique offers the following advantage. The chosen deformation is a (continuous or differentiatable) deformation of space, instead of merely a deformation of the fabric. Each point is thus displaced as a function of its position in three dimensions, and not as a function of its position relative to its adjacent points. The deformations can then be chosen so as to comply with the topological relationships of euclidean space. The result of this choice is that it is not necessary to compute fabric collisions: the lining can no longer pass through the cloth, the sleeve can no longer touch the small side, the garment can no longer penetrate into the dummy, etc. The triangulation is preferably chosen to be dense enough for the deformation of space around an elementary triangle to be considered to be linear.

The computations are performed on the data representative of the garment pieces.

The dummy remains undeformed.

To obtain a deformation that satisfies the above criteria, it suffices to move in one direction along field lines (in the "potential field" sense) coming from the dummy, and, in the other two directions, along the surface of the fabric at the instant in question, while avoiding turning over any triangle in this frame of reference that is local to the fabric. At the edge of the fabric (where the surface is not defined), it suffices to remain at the same equipotential. To avoid undressing when the dummy is too simple (in particular when the torso has no arms), it is possible, for example, to induce a slight downwards tendency.

The cost of computing a potential field is high, but the result depends only on the dummy (and on the type of field chosen). It then suffices to store the field lines together with the dummy. The lines rapidly become straight lines converging on a point, which makes it unnecessary to compute them or to store them over long lengths.

Computing a potential field is described in the work entitled "Introduction to Implicit Surfaces", edited by J. Bloomenthal et al., Morgan Kaufmann Publishers, The Morgan Kaufmann Series in Computer Graphics and Geometric Modeling, 1997.

A deformation function is chosen along each field line. This function is optimized using an energy minimization criterion.

Subdividing the portion of garment (or the corresponding data) to be processed may consist in isolating connected zones that are substantially compressed or stretched. Arbitrarily-connected subdivision is equally effective, but suffers from a slight loss of performance.

The desired result is then achieved: the garment is sewn, put on the dummy, and is subjected only to weak stresses, compatible with launching a realistic simulation of the fabric.

The traction energy of each piece is computed relative to the initial position of the piece, in two dimensions.

For example, for each triangle of the triangulation of the piece in question, the energy variation from the initial position of the triangle is computed, and the energy variations of all of the triangles are then summed.

For each triangle, it is possible to take the variation in the length of one of its sides or the variation in its perimeter as the energy measurement.

For each triangle, it is also possible to compute the energy as a function of its position in 3D (on the dummy), of its rest position in the plane, and of a value for the stiffness K of the fabric.

An example of an energy computation model is given below for each triangle in C++ language.

```
//--------start of the energy computation module---------
struct coord
{
floatUV[2]://co-ordinates of the triangle in the plane
floatXYZ[3]://co-ordinates of the triangle in 3D
};
//The Energy function returns the energy value of a
//triangle deformed in 3D as a function of its position
//at an instant t in 3D, of its rest position in the
//plane, and of a stiffness value K. The units are
//homogeneous.
//the parameters are:
//K: stiffness
//a,b,c: the three points of the triangle
float
Energy (float K,
        const coord*a,
        const coord*b,
        const coord*c)
{
float Uba, Uca, Vba, Vca, surf;
float dX, dY, dZ;
float norm, E;
Uba = b->UV[0] - a->UV[0];
Uca = c->UV[0] - a->UV[0];
Vba = b->UV[1] - a->UV[1];
Vca = c->UV[1] - a->UV[1];
surf = Vca * Uba - Vba * Uca;
dX = (Vca * (b->XYZ[0] - a->XYZ[0] - Vba(c->XYZ[0] -
a->XYZ[0]))/surf;
dY = (Vca * (b->XYZ[1] - a->XYZ[1] - Vba(c->XYZ[1] -
a->XYZ[1]))/surf;
dZ = (Vca * (b->XYZ[2] - a->XYZ[2] - Vba(c->XYZ[2] -
a->XYZ[2]))/surf;
norm = sqrtf(dX*dX + dY*dY + dZ*dZ) - 1.0f;
E = K * surf * norm * norm/4;
return E;
}
//----------end of energy computation module---------
```

Figure 14:
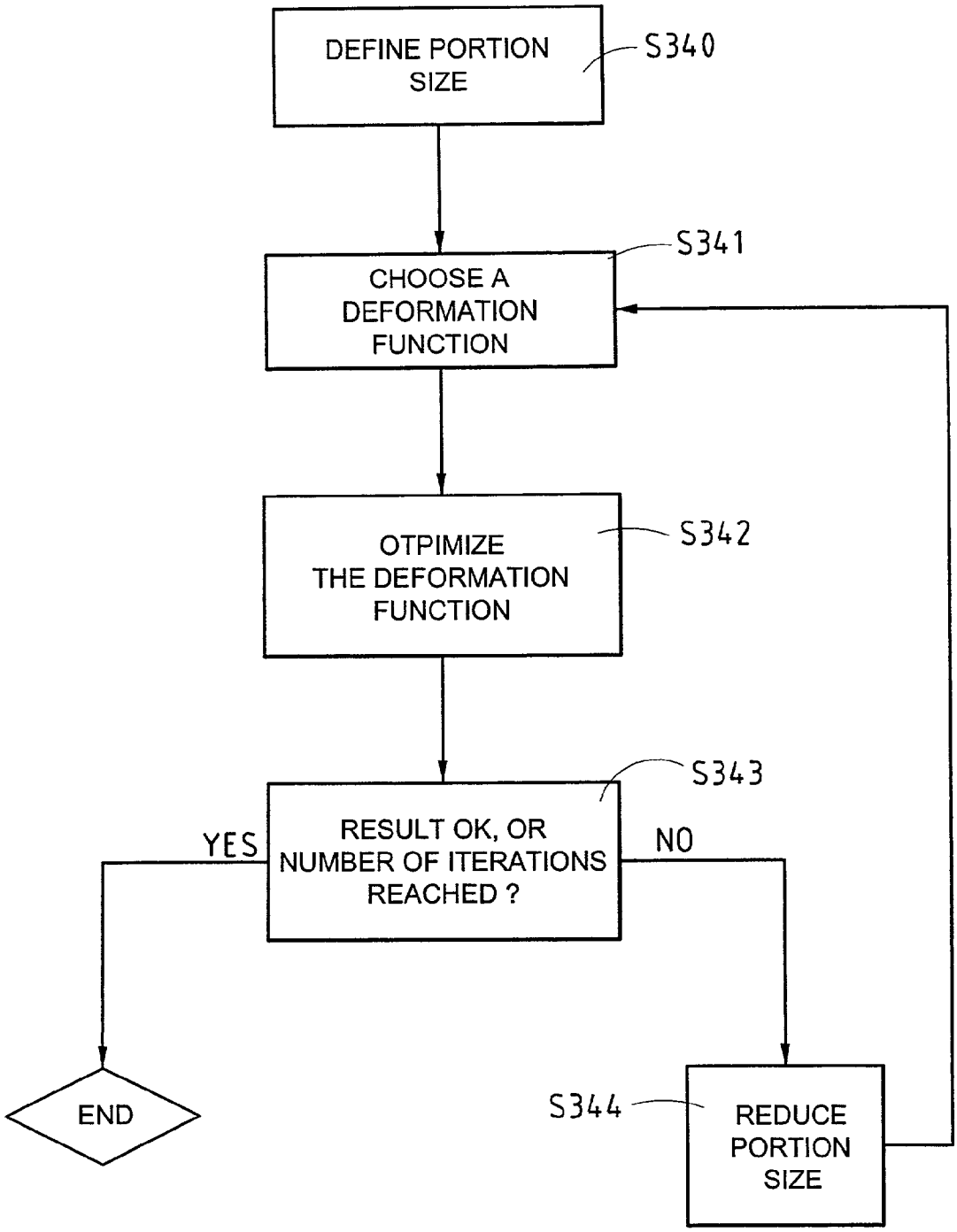
FIG. 14 shows the steps of a relaxation method of the invention.

FIG. 14 shows the steps of a relaxation method of the invention. As above, these steps are performed on the stored garment data.

A first set of portions is defined as a function of size (step S340).

A deformation function is then chosen for each field line (step S341). This function is optimized as a function of an energy-minimizing criterion (step S342). The energy function is naturally previously defined.

Once optimization has been achieved, another subset of smaller portions is defined (S344) and a deformation function is chosen again as a function of the field lines, and is optimized. The algorithm stops when the operator deems that the result is satisfactory, or after a predetermined number of iterations (step S343).

The question of displacing a triangular mesh point without turning over occurring is addressed below.

Figure 15A:
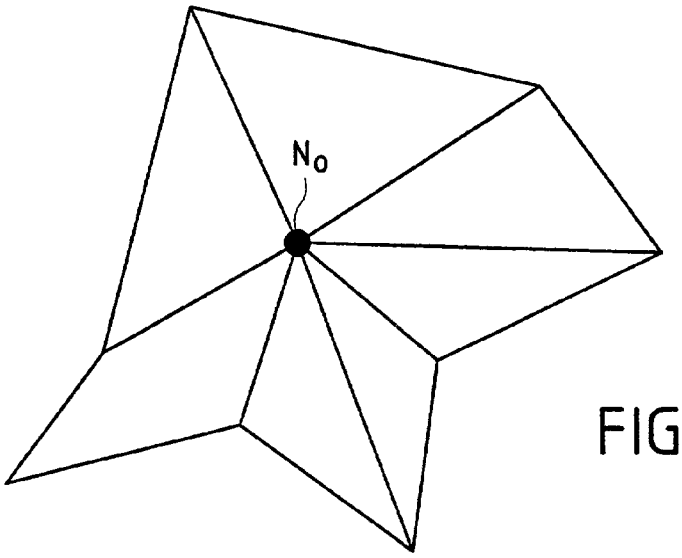
FIGS. 15A and 15B show a mesh node surrounded by triangles.
Figure 15B:
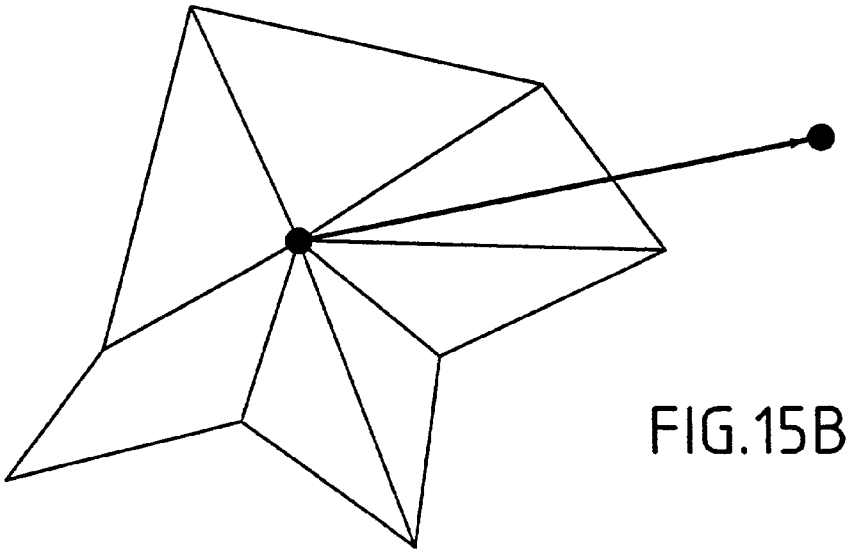

The problem posed is explained with reference to FIGS. 15A and 15B, showing a mesh node No surrounded by triangles. It is desired to displace No without turning over any triangle, unlike what occurs in FIG. 15B.

Figure 16:
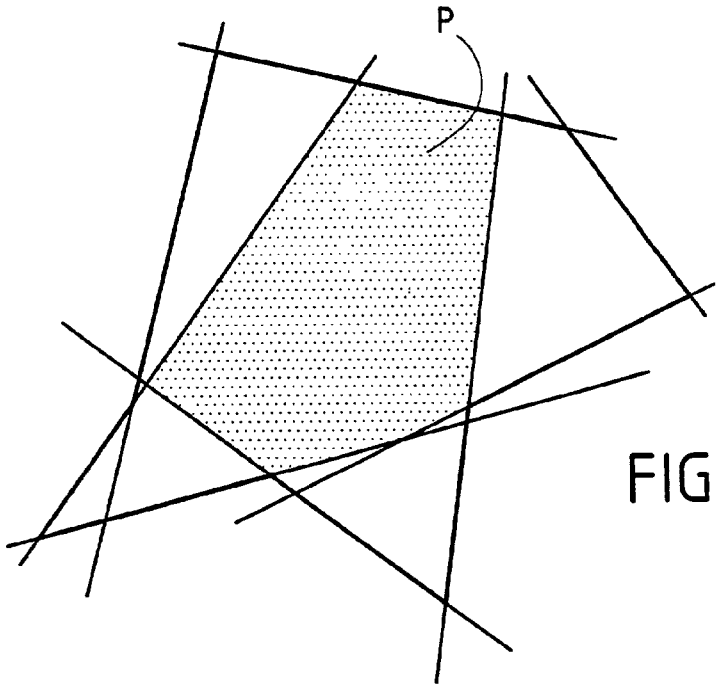
FIG. 16 shows a polygon in a set of triangles, this polygon containing all of the points that see the outside outlines of all of the triangles.

Firstly (FIG. 16), the (convex) polygon containing all of the points P such that P "sees" the outside outlines of the triangles is computed. It is constituted by the intersection (shaded in FIG. 16) of the half-planes defined by all of the sides of the outline. This intersection is not empty because the original node No satisfies the constraint. It can be noted that, if the outline is convex, no computation is necessary, any point within the outline then being a point P.

Figure 17A:
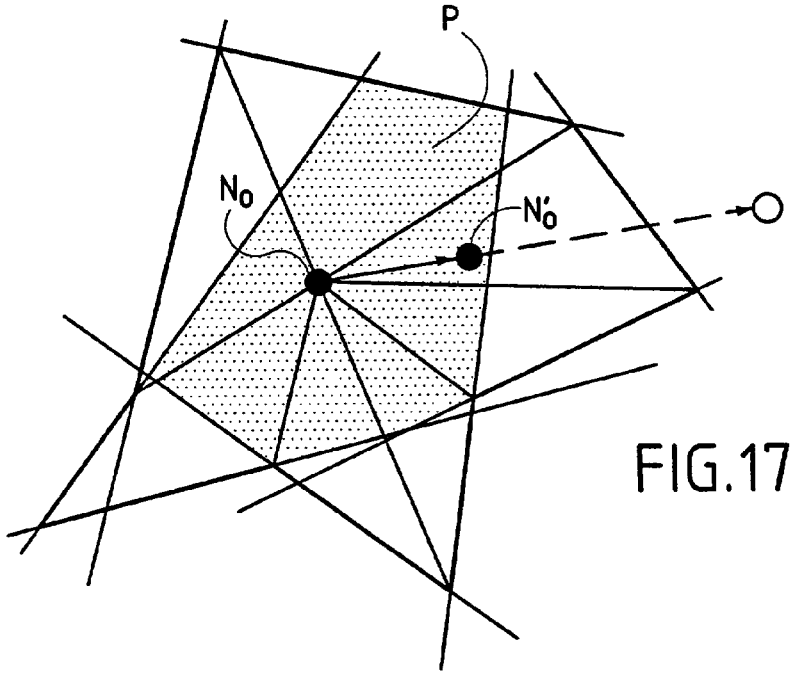
FIGS. 17A and 17B shows the displacement of a triangular mesh point that avoids turn-over problems.
Figure 17B:
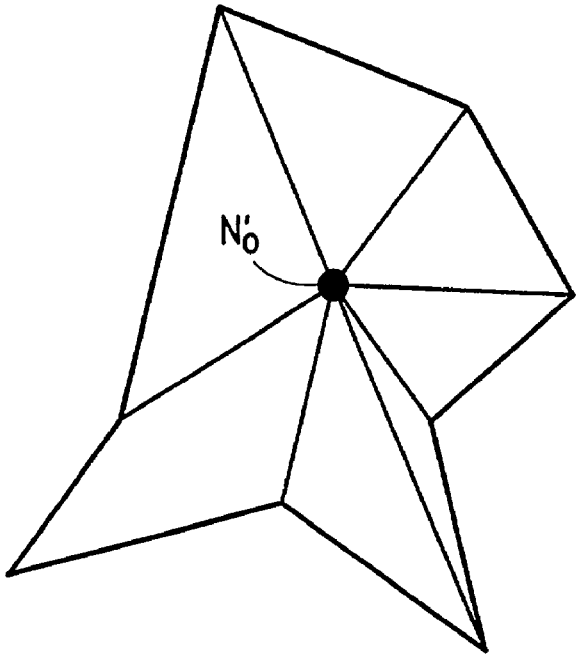

The result is a convex polygon. It is then possible to compute an intermediate final point No' that keeps the triangles the same way up, as shown in FIG. 17A. FIG. 17B shows the resulting polygon.

Figure 18:
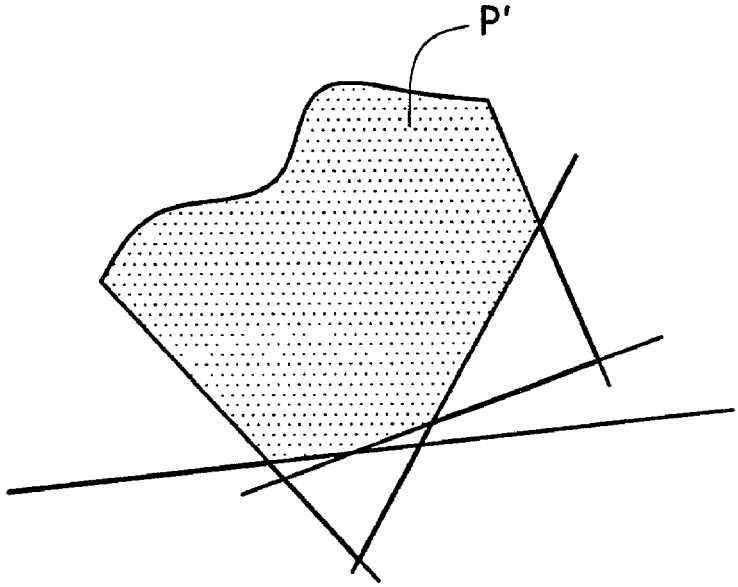
FIG. 18 shows the zone in which a triangular mesh point can be displaced compatibly with the condition of not being turned over, i.e. upside-down.

The problem is the same for a point on the edge (i.e. not entirely surrounded by triangles) except that the resulting convex can be open, as shown in FIG. 18.

Therefore, a triangular mesh point is displaced without triangles turning over, provided that the displacement is limited to within a polygon that defines the boundary of all the points that see the outside outline of the triangles directly from the inside.

Complying with the non-turn-over constraint thus consists in testing the directions of rotation of the triangles adjacent to the relevant point to be displaced, and, if turning over is detected (a rotation direction which reverses), in trying again with a smaller displacement (e.g. one half of the initial displacement). In the event of total failure, it is possible to try to unblock the situation by displacing the point randomly.

Figure 19:
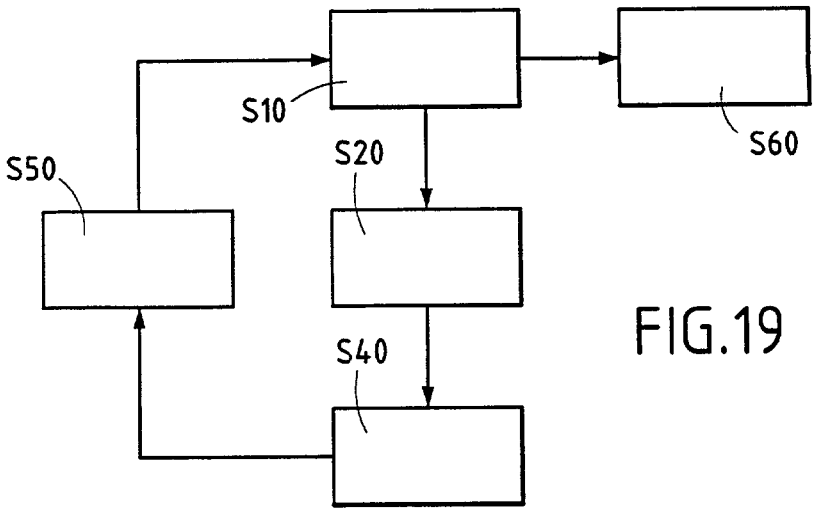
FIG. 19 diagrammatically shows a general method of the invention for dressing a dummy, for performing simulation, and for analyzing "wearability"

FIG. 19 is a general block diagram of a method of the invention that may include the above-described operations.

In a first step (S10), the shapes, or subsets of garment are defined as flat, in two dimensions. During this step, the assembly positions of the various points may also be defined. This step may be implemented by means of the software sold by Lectra under the name "Modaris".

Step S20 covers the operations of dressing the dummy, as described above.

In particular, after they have been selected, the garment pieces are placed against the surface of the dummy, without taking account of their physical parameters. Then, the pieces are joined together, followed by the relaxation operation.

A simulation step (S40) may then take place, e.g. by using the method of finite elements. A simulation method that may be used is described by D. Barafff et al. "Large Steps in Cloth Simulation": Sigraph 1998, Computer Graphics Conference Proceedings, Addison-Wesley, ISBN 0-201-30988-2.

The "wearability" of the garment can then be analyzed (step S50): the operator can then view the garment, analyze the configuration or the overall impression. If the operator is not satisfied with something (e.g. a particular garment piece does not fit a portion of the body), it is possible to select a new garment piece to replace the preceding piece, or else to modify the garment piece, e.g. by means of the Applicant's "Modaris" software.

In which case, the dummy is dressed once again (step S20). The method is then reiterated from the step in which the pieces are pressed against the corresponding or homologous shapes of the dummy and laid flat. Bijectivity is used to transfer the data to the surface of the dummy for the shape or the portion that has been subjected to modification or substitution. Then the edges of the piece are joined to the adjacent pieces. The relaxation process can then be executed again, and it acts on the entire garment to bring it to its position of equilibrium on the dummy. Thus, it is possible to take account of all of the possible interactions between the modified piece and all of the other garment pieces.

Otherwise, i.e. if the operator is satisfied, the garment can be manufactured (step S60).

Figure 20:
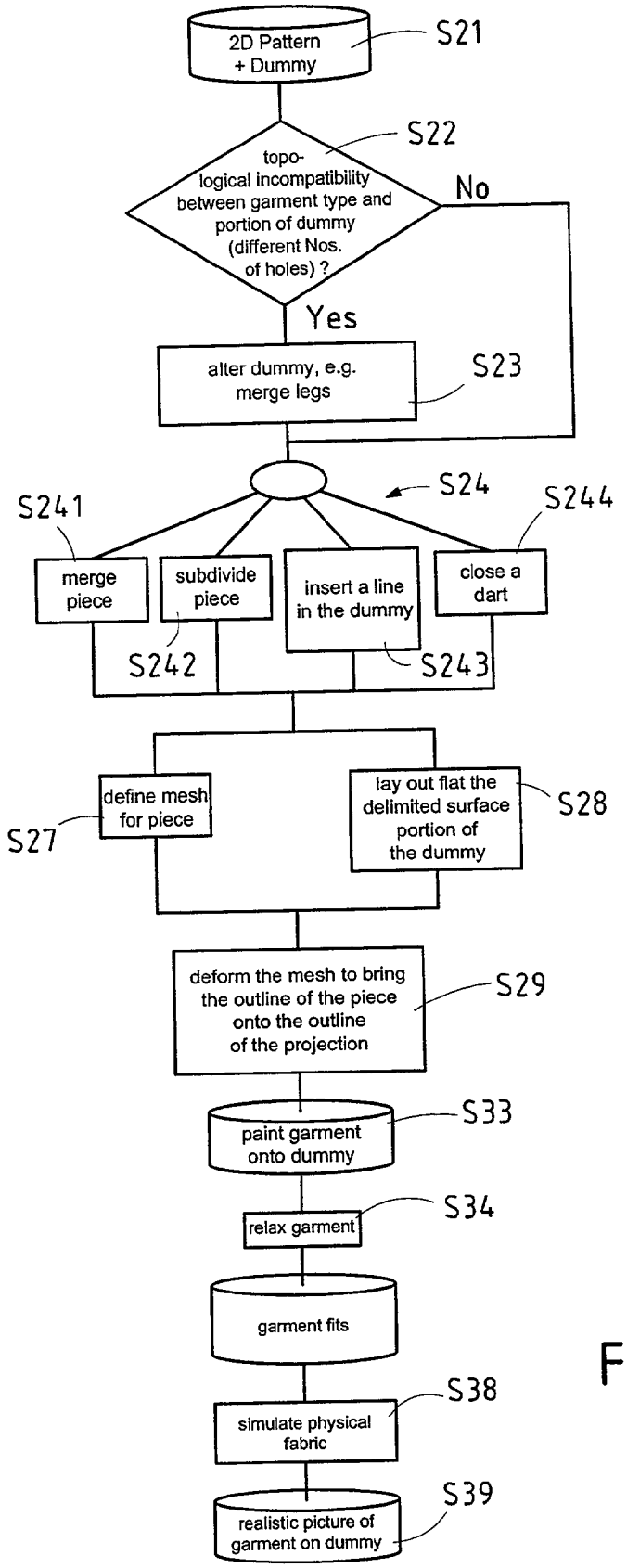
FIG. 20 shows the steps of a method of the invention for dressing a dummy.

FIG. 20 is a detailed flow chart representing a dressing method of the invention.

In a first step (S21) the flat pattern (two-dimensional representation) and the dummy are selected.

It is then possible to verify (step S22) that the type of garment selected is topologically compatible with the corresponding portion of the dummy. For example, it is possible to verify whether the number of holes in the garment corresponds to the number of holes in said portion of the dummy. If they are not compatible, it is possible to alter the dummy (step S23), e.g. by merging portions of the dummy or by determining a surface derived from the dummy, as explained above.

Steps S24 (S241–S244), S25 and S26 are performed for each pair constituted by a garment piece and by a surface or a portion of the dummy.

For a partial piece, or a piece provided with a dart cut, or a complex piece, one of the following steps may be performed:

step S241: merging the piece with another piece;

step S242: subdividing the complex piece;

step S243: inserting a corresponding line on the dummy; and step S244: closing the dart cut.

Then, a mesh is defined for the piece (step S27), which determines the number of points to be put in correspondence with points on the dummy, and the corresponding surface of the dummy is laid out flat (step S28).

The outline of the piece can then be brought onto the outline of the projection of the dummy (step S29): the mesh is thus progressively deformed.

Thus (S33), the garment is "painted" on the dummy.

This step S33 terminates the putting into place of the garment on the dummy.

The garment can then be relaxed (step S34). Then comes the mechanical simulation step (S38) which makes it possible, for a given fabric, to find the correct drape for it, and which makes it possible to remove any remaining deformations. A realistic image of the garment as put on the dummy is thus obtained (S39).

Figure 21A:
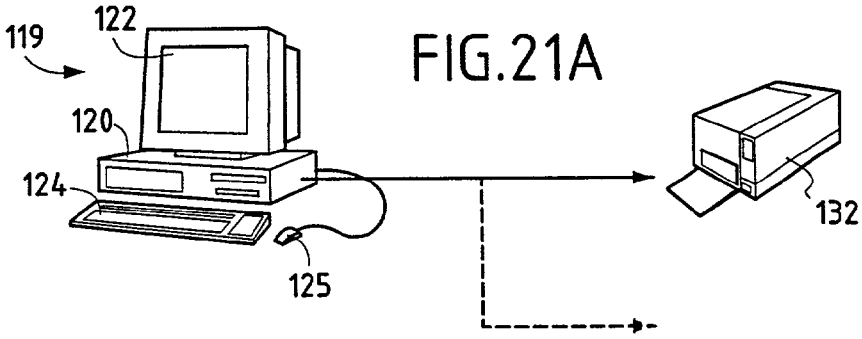
FIGS. 21A and 21B show apparatus for implementing the invention.
Figure 21B:
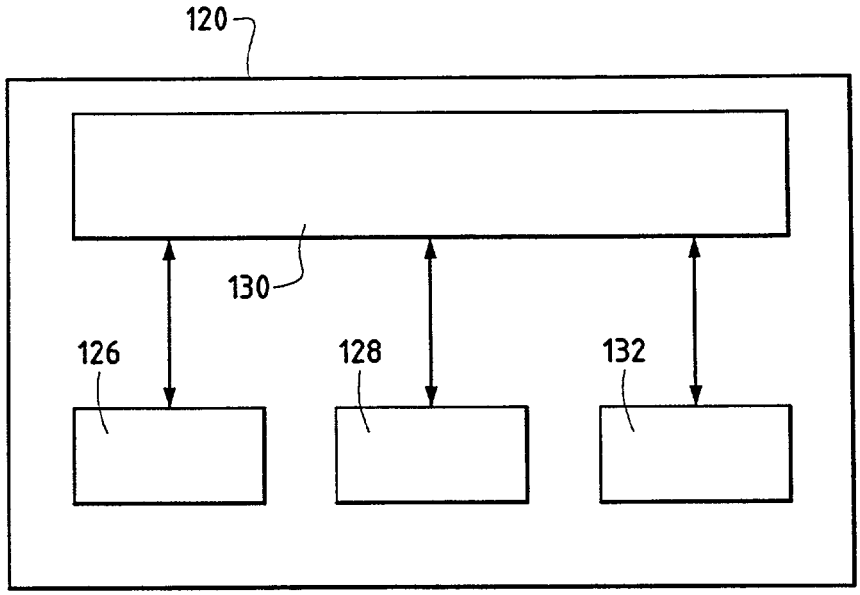

An example of apparatus for implementing the method of the invention is shown in FIGS. 21A and 21B and described below. The apparatus is designated by overall reference 119.

FIG. 21A is an overall view of a graphics station comprising a micro-computer 120 configured appropriately for using a method of the invention to process dummy models and garment pieces, viewing apparatus 122, and control peripherals (e.g. a keyboard 124 and a mouse 125). The micro-computer 120 includes a computing section with all of the electronics components, software, or other components necessary for simulating the dressing of a dummy with garment pieces.

Thus, for example (FIG. 21B), the system 120 comprises a programmable processor 126, a memory 128, and an input peripheral, e.g. a hard disk 132, coupled to a system bus 130. For example, the processor may be a microprocessor or a processor of a central processing unit or of a graphics workstation. For example, the memory 128 may be a hard disk, a read-only memory (ROM), a CD-ROM (an optical compact disk), a dynamic random access memory (DRAM) or any other type of RAM, a magnetic or optical element, registers or other volatile and/or non-volatile memories. A dummy-dressing algorithm includes instructions that can be stored in the memory and that make it possible to dress the dummy with one or more garment pieces, using any one of the implementations of the present invention. A program making it possible to implement the method of the invention is resident or recorded on a medium (e.g. a floppy disk or a CD ROM, or a removable hard disk or a magnetic medium) suitable for being read by a computer system or by the micro-computer 120. The program provides a method for dressing a dummy represented in three dimensions with garment pieces. It includes instructions for:

- placing or computing the placing of the garment pieces on the surface of the dummy or on a surface derived from the surface of the dummy;
- joining together or computing the joining together of the garment pieces along their seam lines; and
- relaxing or computing the relaxation of the pieces of the garment from their position on the surface of the dummy to their equilibrium position.

The micro-computer may include computing means for computing, for example, the projections of the selected portions of the dummy, or for computing the values of potential field lines, if they are not already pre-associated with the selected dummy, or else for performing the triangulations and their deformations, and/or the operations of applying the garment to the dummy. The computing means also make it possible to compute the energies (traction energy) and to minimize the computed energies during relaxation.

The micro-computer 120 may be programmed to generate dummy shapes, or else such shapes may be pre-stored, e.g. in the memory 128. Likewise, shapes of garment pieces may also be pre-stored. In which case, means are provided that make it possible to select a dummy and one or more garment pieces. These elements may have been obtained by computer-aided design (CAD) or by automatic generation systems.

The micro-computer 120 may also be connected to other peripheral apparatus, such as, for example, printing apparatus 132. It may be connected to an electronics network, e.g. of the Internet or Intranet type, making it possible to send data relating to the dummies and/or to the garments.

It is possible to display on the screen 122 an image representing a dummy selected by an operator. The operator also selects the garment pieces that are placed against the surface of the dummy, without taking account of their physical characteristics, as explained above. It is also possible to perform an intermediate display on the apparatus 122 of the pieces of the garment as pressed against the dummy, and thus in their compressed state, prior to relaxation. Then, the operation of joining the pieces together takes place, followed by the relaxation step.

The operator can then view the garment, analyze the configuration or the overall impression, and, if the operator is not satisfied with something, can select a new garment piece to replace the preceding piece, or can modify a garment piece.

It is also possible to make the garment physically, e.g. by operations of cutting out pieces of fabric, after the pieces have been validated by simulation. Such a cutting-out operation may be performed using known methods and apparatus, e.g. as described in Document U.S. Pat. No. 5,825,652.

Figure 22:
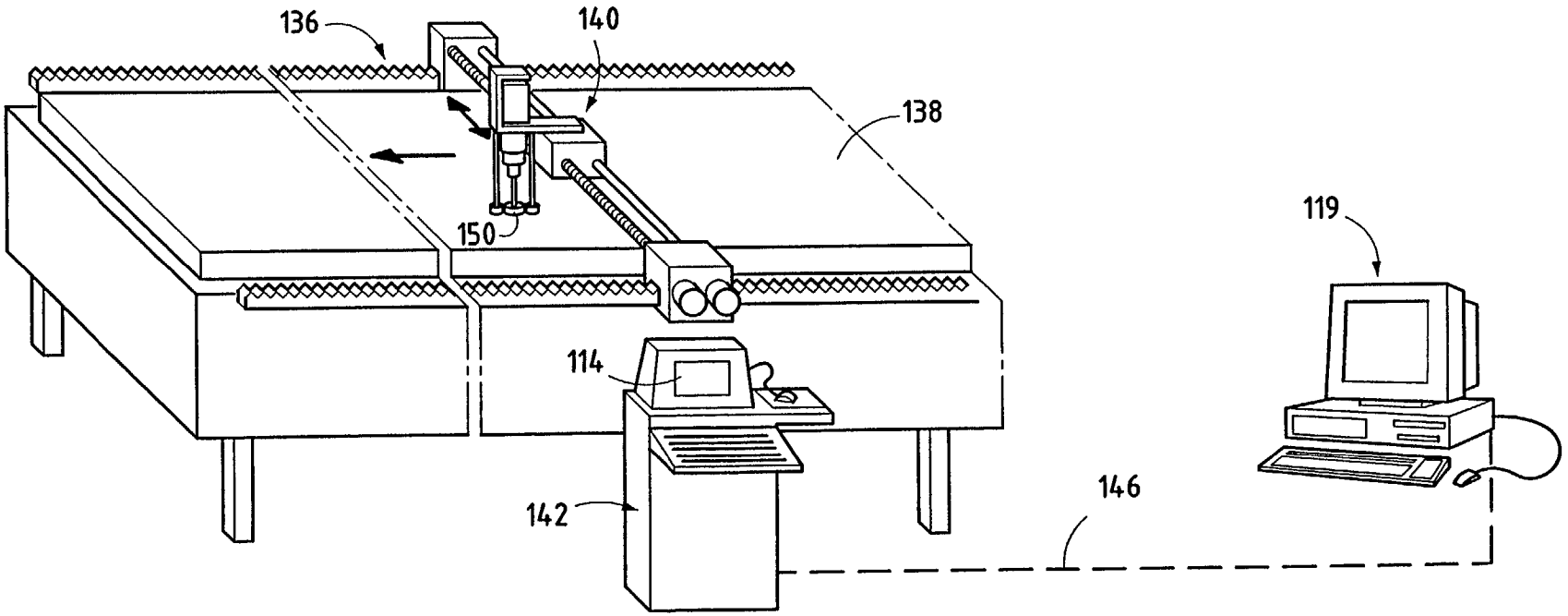
FIG. 22 shows cutting-out apparatus coupled to simulation and viewing apparatus of the invention.

Such apparatus is shown in FIG. 22. It includes means 136 of the cutting-out table type on which sheets 138 of material, e.g. woven fabric, to be cut up can be positioned, means 140 for positioning and displacing a cutting tool 150 above said table, and control means 142 for controlling the positioning and cutting means. The control means are computer means. They may further include means 144 for viewing the piece to be cut out, whose data has been transmitted, and/or means for viewing the zone of the piece positioned on the cutting-out table.

The data concerning the pieces, which data is validated in the invention by simulation by means of the apparatus 119, may, for example, be transmitted to the control means 142 for controlling the cutting device via a link 146 of an electronic communications network. It is also possible to store the data on a medium of the floppy disk type, and then to load it into a memory of the control means 142 for controlling the cutting device.

What is claimed is:

1. A method of viewing a garment made up of garment pieces, represented by data stored in a memory of a computer, and having seam lines, on a dummy model having a surface represented by data stored in a memory of a computer, said method comprising:

- placing the garment pieces on the surface of the dummy model;
- joining together the garment pieces along their seam lines; and
- relaxing each garment piece from its position on the surface of the dummy model to its equilibrium position on the dummy model.

2. The method according to claim 1, wherein the garment pieces are placed on the surface of the dummy model by establishing a bijective and continuous relationship between at least a portion of a garment piece and a corresponding portion of the surface of the dummy model.

3. The method according to claim 2, wherein the garment pieces are placed on the surface of the dummy model by establishing a bijective and continuous relationship between points representative of a garment piece and points on a corresponding portion of the surface of the dummy model.

4. The method according to claim 2, wherein the establishing of a bijective and continuous relationship between a garment piece and a corresponding portion of the surface of the dummy model comprises:

- selecting a portion of the dummy model that corresponds topologically or is topologically homologous, to the garment piece;
- projecting said portion of the dummy model on a plane; and
- deforming the piece to bring it to coincide with said projection.

5. The method according to claim 4, in which:

- a triangulation of the garment piece is performed; and
- the triangulation of the piece is deformed to bring it to coincide with said projection.

6. The method according to claim 5, the triangulation of the piece being deformed by:

displacing points defining an outline of the piece to points on an outline of said projection; and displacing the points that are vertices of triangles within the outline of the piece.

7. The method according to claim 5, the triangulation being deformed while satisfying a constraint whereby the triangles of the triangulation of the piece are not turned over.

8. The method according to claim 1, wherein the relaxing of a garment piece comprises:

subdividing the garment piece into a first set of portions; and deforming said set of portions while minimizing an energy function of the garment piece.

9. The method according to claim 8, wherein the relaxing of the garment piece further comprising:

subdividing the garment piece into a second set of portions that are smaller than the portions of the first set; and deforming the second set of portions while minimizing an energy function of the garment piece.

10. The method according to claim 8, wherein the energy function represents the traction energy of the garment piece.

11. The method according claim 8, wherein the energy function of the garment piece is computed relative to the position of the piece in two dimensions, and as a function of a value for the stiffness K of a fabric.

12. The method according to claim 8, wherein the deforming of the sets of portions comprises:

a displacement along field lines coming from the dummy model; and a displacement along the surface of the fabric, in the other directions.

13. The method according to claim 12, wherein data corresponding to the field lines is pre-stored.

14. The method according to claim 9, wherein the portions of the first and second sets of portions are connected zones of the garment piece.

15. The method according to claim 1, wherein a garment piece is provided with a dart cut which is closed prior to placing said piece on the surface of the dummy model.

16. The method according to claim 1, wherein two garment pieces are joined together prior to placing them on the surface of the dummy model.

17. The method according to claim 1, wherein one of the garment pieces is subdivided into at least two subpieces before being placed on the surface of the dummy model.

18. The method according to claim 1, further comprising:

selecting one of the relaxed garment pieces referred to as a piece to be replaced;

selecting another garment piece referred to as a replacement piece;

placing the replacement piece on the surface of the dummy model;

joining the replacement piece to the other pieces along its seam lines, where applicable; and relaxing all of the garment pieces from their position on the surface of the dummy to their equilibrium position on the dummy model.

19. The method according to claim 1, further comprising:

selecting one of the relaxed garment pieces referred to as a piece to be modified;

modifying said piece;

placing said piece as modified on the surface of the dummy model;

joining the modified piece to the other pieces along its seam lines, where applicable; and relaxing all of the pieces of the garment from their position on the surface of the dummy to their equilibrium position on the dummy model.

20. The method according to claim 1, further comprising a step of mechanically simulating the garment.

21. A method of making garment pieces, said method comprising:

pre-viewing the garment on a dummy model using a method according to claim 1; and making the pieces of the garment.

22. An apparatus for viewing garment pieces on a dummy model having a surface, said apparatus comprising:

computer means for:

placing garment pieces on the surface of the dummy model;

joining together the garment pieces along their seam lines; and relaxing the pieces of the garment from their position on the surface of the dummy model to their equilibrium position on the dummy model; and viewing means for viewing the dummy model and the garment pieces on the dummy model.

23. The apparatus according to claim 22, further having means for previewing the selected dummy model or the selected garment pieces.

24. The apparatus according to claim 22, further comprising means for modifying a selected garment piece or for replacing a garment piece with another garment piece.

25. The apparatus according to claim 22, further comprising means for selecting garment pieces from a pre-established garment database.

26. The apparatus according to claim 22, further comprising means for selecting a dummy model from a pre-established dummy model database.

27. The apparatus according to claim 22, further comprising means for storing data relating to the garment pieces and/or to the dummy model.

28. An apparatus for making garment pieces, the apparatus comprising:

viewing apparatus according to claim 22;

cutting-out means for cutting out garment pieces; and data-transmission means for transmitting data between the viewing apparatus and the cutting-out means for cutting out the garment pieces.

29. The apparatus according to claim 28, the cutting-out means for cutting out the garment pieces being controlled by a microcomputer, and the data-transmission means interconnecting the viewing apparatus and the micro-computer.

30. The apparatus according to claim 28, the data transmission means being part of a communications network.

* * * * *